US005363870A

United States Patent [19]

Doyon

[11] Patent Number: 5,363,870

[45] Date of Patent: Nov. 15, 1994

[54] BRUSH CLEANER

[75] Inventor: Roger L. Doyon, Scottsville, N.Y.

[73] Assignee: RKS Marketing Corporation, Rochester, N.Y.

[21] Appl. No.: 152,311

[22] Filed: Nov. 12, 1993

[51] Int. Cl.[5] ..... B08B 3/04

[52] U.S. Cl. ..... 134/184; 134/201; 15/257.05; 206/15.3

[58] Field of Search ..... 134/135, 184, 183, 201, 134/182; 206/15.3; 401/127; 15/257.05; 215/6

[56] References Cited

U.S. PATENT DOCUMENTS

| | | | |
|---|---|---|---|
| 748,254 | 12/1903 | Bernard | 15/257.05 |
| 799,747 | 9/1905 | Martin | 206/15.3 |
| 1,050,381 | 1/1913 | Oleson | 206/15.3 |
| 2,436,291 | 2/1948 | Daniel | 15/257.05 |
| 3,955,670 | 5/1976 | Buslik | 206/15.3 |
| 4,533,044 | 8/1985 | Ban | 206/15.3 |
| 5,007,553 | 4/1991 | Curtis | 206/15.3 |
| 5,022,559 | 6/1991 | Condon | 206/15.3 |

*Primary Examiner*—Frankie L. Stinson
*Attorney, Agent, or Firm*—Howard J. Greenwald

[57] ABSTRACT

An apparatus for cleaning and reforming a brush which contains a base and a cover removably attached to said base. The cover is a laminated structure containing a top wall, an intermediate layer, and a bottom wall. Each of the top wall and the bottom wall contains at least three orifices, and least two of which differ from at least one of the other. The intermediate layer contains elastmeric material and at least three orifices, each of which is smaller than any of the orifices in the top wall or the bottom wall.

18 Claims, 4 Drawing Sheets

BRUSH CLEANER

FIELD OF THE INVENTION

A vessel for cleaning and reforming brushes which is comprised of a base, a top removably attached to the base, and a multiplicity of orifices in the top.

BACKGROUND OF THE INVENTION

Porcelain brushes are used to apply porcelain to dental appliances, such as caps and bridges. Powdered porcelain material is first formed into a paste after being mixed with liquid, and the paste is then brushed onto the dental appliance. These brushes are rather expensive, costing from about ten to about sixty dollars apiece.

Unless the porcelain paste material is thoroughly cleaned from the bristles and shafts of such brushes after each use, the lifespan of the brushes will be only about one month. Such paste, after drying, becomes a dried agglomerate which impregnates the bristles and shaft of the brush and tends to render the brush useless for the application of porcelain paste material to dental appliances.

Elaborate and time-consuming protocols have been devised for the cleaning of the porcelain brushes. Thus, for example, one must generally manually wash the brush thoroughly, then shake out the brush to remove excess water and lost ceramic particles, and then manually reshape the head of the brush into its original shape. However, even this time consuming manual process is not entirely satisfactory. Frequently the porcelain particles will remain lodged in both the bristles and the shaft head.

It is an object of this invention to provide an apparatus which is adapted to clean a porcelain brush and effectively remove porcelain particles from the bristles and the shaft head of the brush.

It is another object of this invention to provide an apparatus which is adapted to reform the head of the brush while simultaneously removing excess water and porcelain particles.

It is another object of this invention to provide an apparatus for cleaning porcelain brushes in which a multiplicity of such brushes can be removably and readily mounted.

It is another object of this invention to provide an apparatus for cleaning porcelain brushes which is capable of maintaining such brushes in a stable vertical position during the cleaning operation.

It is another object of this invention to provide an process for cleaning a porcelain brush and effectively removing porcelain particles from the bristles and the shaft head of the brush.

SUMMARY OF THE INVENTION

In accordance with this invention, there is provided an apparatus for cleaning and reforming a multiplicity of brushes which is comprised of a base and a cover removably attached to the base. The cover has a top wall which is a laminated structure containing a bottom layer of plastic material, an intermediate layer of elastomeric material, and a top layer of plastic material. A multiplicity of orifices extend through the top wall.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

The apparatus of this invention is designed to thoroughly clean and reshape a multiplicity of brushes. As is known to those skilled in the art, a brush is a device comprised of bristles fastened into a handle.

By way of illustration, the brush(es) cleaned in the apparatus and process of this invention is a cosmetic brush which is used to apply cosmetic material to a user. These brushes are readily commercially available, are known to those skilled in the art, and are described, e.g., in U.S. Pat. Nos. 4,993,440 (a cosmetic brush comprising an elongate central core around which there are implanted substantially radially disposed bristles), 4,974,981 (a cosmetic powder brush), 4,898,193 (a mascara brush), D304,392, D278,952, and the like. The disclosure of each of these United States patents is hereby incorporated by reference into this specification.

Figure 1:
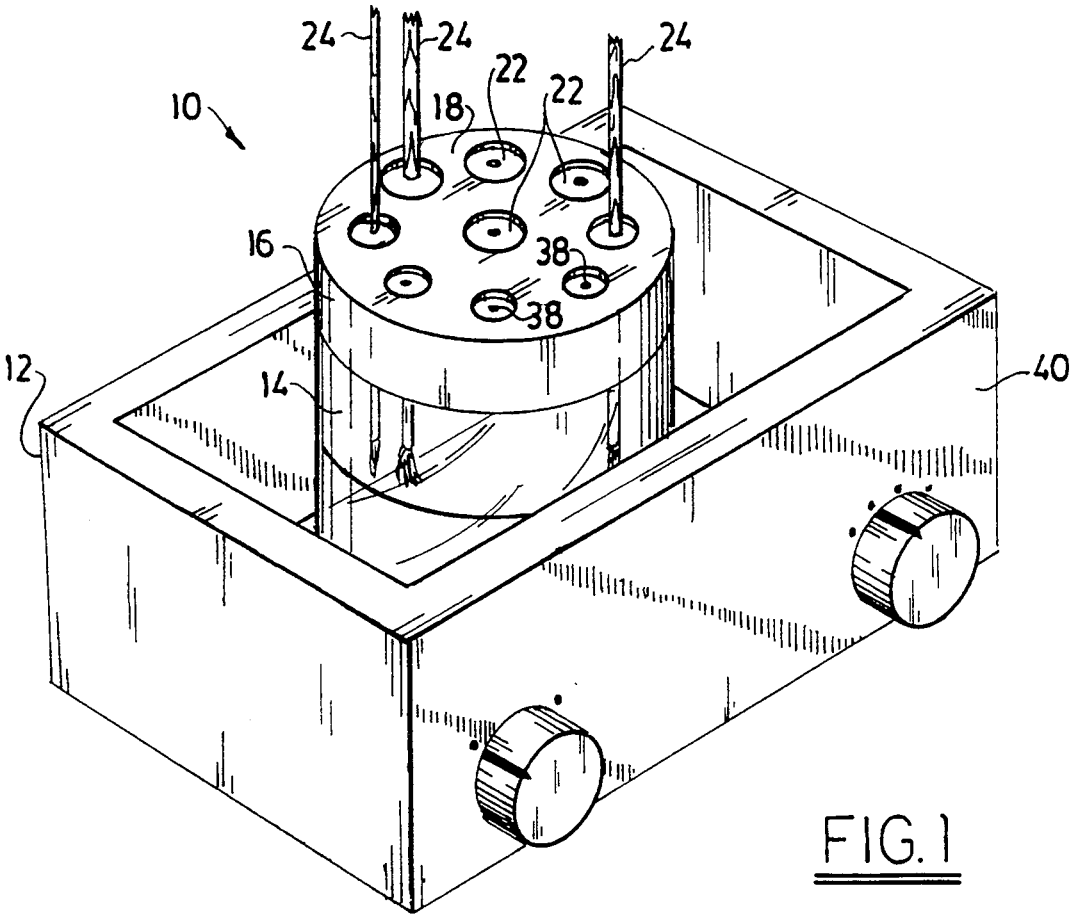
FIG. 1 is a perspective view of one preferred embodiment of applicant's cleaner disposed within an ultrasonic generator.
Figure 2:
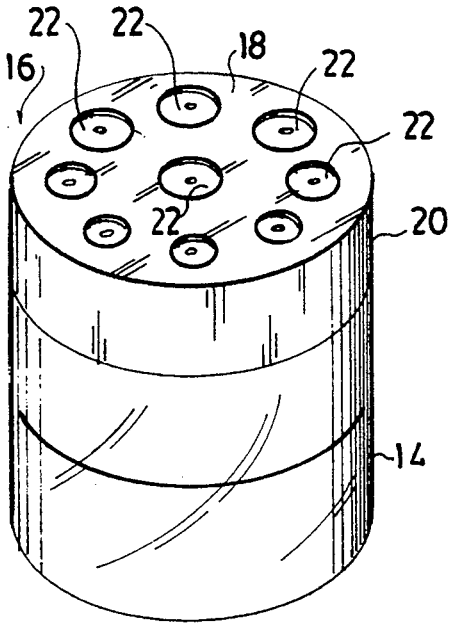
FIG. 2 is a perspective view of the cleaner of FIG. 1.
Figure 3:
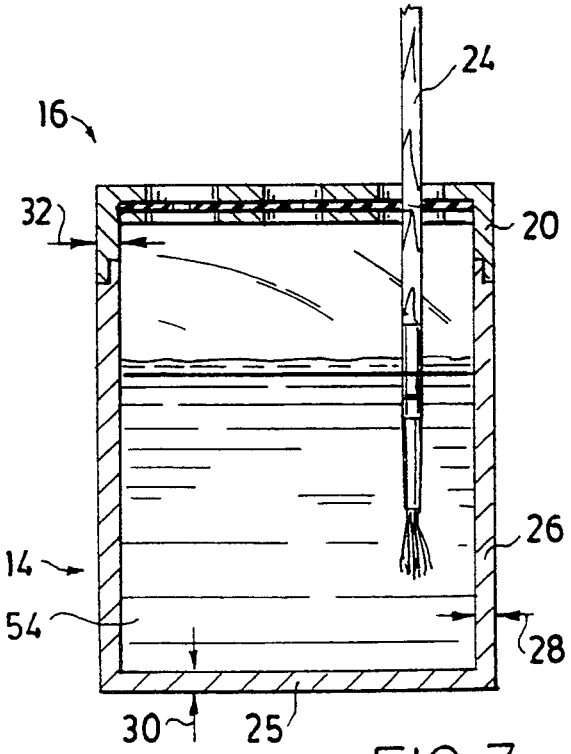
FIG. 3 is a sectional view of the cleaner of FIG. 1.

FIG. 1 is a perspective view of a preferred embodiment of a brush cleaner 10 disposed within ultrasonic wave generator 12.

Referring to FIG. 1, it will be seen that brush cleaner 10 is comprised of a base 14, a cover 16.

It will be seen that cover 16 is removably attached to base 14. In the preferred embodiment depicted in the FIGS. 1–4, cover 16 is comprised of a top wall 18 and a circumferential side wall 20.

Figure 4:
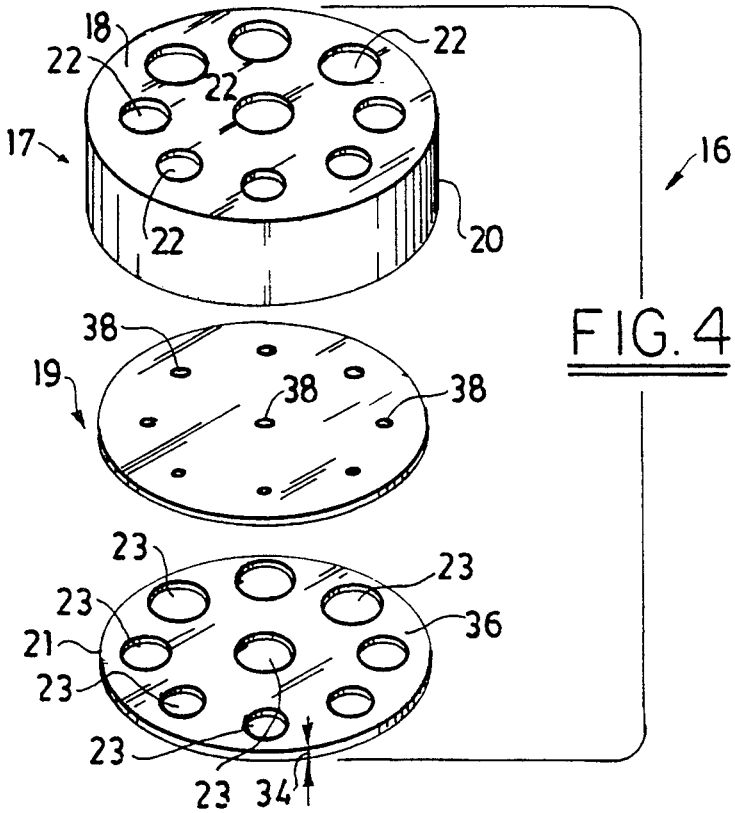
FIG. 4 is an exploded view of the cleaner of FIG. 1.

FIG. 4 is an exploded view of one preferred embodiment of cover 16. Referring to FIG. 4, it will be seen that cover 16 is preferably a laminated structure comprising a top portion 17, an intermediate portion 19, and a bottom portion 21.

Referring again to FIG. 4, it will be seen that the wall 18 of top portion 17 of cover 16 is preferably comprised of a multiplicity of orifices 22 through which brushes 24 (see FIGS. 2 and 3) may be inserted, disposed, and maintained during the cleaning operation.

In the preferred embodiment illustrated in FIGS. 1 through 4, the top wall 18 of top portion 17 is preferably comprised of at least three orifices 22. It is more preferred that the top wall 18 comprise at least six orifices 22.

It is preferred that each of orifices 22 have a substantially circular cross-sectional shape, although other shapes (such as an oval shape, a square shape, and the like) also may be used. As is illustrated by the preferred embodiment depicted, it is also preferred that at least two of such orifices 22 have a maximum dimension (such as a diameter) which are different. In one embodiment, at least three of such orifices 22 have a maximum dimension which differs from the maximum dimensions of at least one of the other orifices 22.

The top portion 17 of cover 16 is preferably an integral structure. It is preferred that each of top portion 17 and bottom portion 21 consist essentially of plastic material.

In one preferred embodiment, the plastic material used in top portion 17 and bottom portion consist of a thermoplastic material or a thermoset material which can be formed by injection molding. This injection molding process is well known to those skilled in the art and is described, e.g., on pages 83–155 of Joel Frados' "Plastics Engineering Handbook," Fourth Edition (Van Nostrand Reinhold Company, New York, 1976).

It is preferred that each of top portion 17 and bottom portion 21 (as well as base 14) consist essentially of plastic material which, when formed into such structures, is substantially transparent.

Referring again to FIG. 3, it will be seen that base 14 is comprised of a bottom wall 25 and a side wall 26 with a thickness 28 which is from about 0.05 inches to about 0.15 inches. In a more preferred embodiment, the thickness 28 of side wall 26 will preferably range from about 0.06 inches to about 0.13 inches.

The bottom wall 25 of base 14 also will have a thickness 30 which is from about 0.05 to about 0.15 inches. In one preferred embodiment, thickness 28 and thickness 30 are substantially the same.

Referring again to FIG. 3, it will be seen that cover is comprised of side wall 20 which, in the embodiment depicted, has a thickness 32 of from about 0.05 to about 0.15 inches. In one preferred embodiment, thickness 32 and thickness 30 and thickness 28 which are each substantially the same. Furthermore, referring to FIG. 4, the thickness of top wall 18 of top portion 17 also is preferably from about 0.05 to about 0.15 inches.

Without wishing to be bound to any particular theory, applicant believes that the thickness 28 and/or 30 and/or 32 should be in the specified range to optimize the ultrasonic cleaning obtainable in the preferred process of the invention.

Referring again to FIG. 4, and in the preferred embodiment depicted therein, it will be seen that bottom portion 21 of cover 16 also is an integral structure which preferably consists essentially of plastic material. Bottom portion 21 preferably has a thickness 34 of from about 0.05 to about 0.15 inches.

Figure 5:
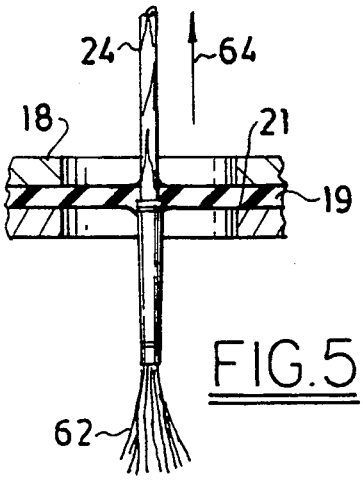
FIGS. 5, 6, and 7 are each partial sectional views of the top wall of the cleaner of FIG. 1, illustrating how a brush may be reformed as it is pulled through such top wall.
Figure 6:
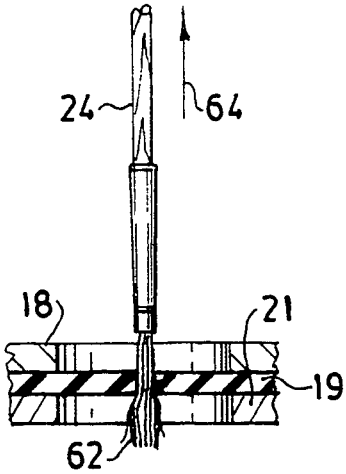

In the preferred embodiment illustrated in FIG. 1, the bottom portion 21 is comprised of at least three orifices 23 which, when bottom portion 21 is disposed within top portion 17, can each communicate with an orifice in the top wall 18; see, e.g., FIGS. 5 and 6. It is more preferred that the bottom wall 21 comprise at least six orifices 23.

It is preferred that each of orifices 23 have a substantially circular cross-sectional shape, although other shapes (such as an oval shape, a square shape, and the like) also may be used. As is illustrated by the preferred embodiment depicted, it is also preferred that at least two of such orifices 23 have a maximum dimension (such as a diameter) which are different. In one embodiment, at least three of such orifices 23 have a maximum dimension which differs from the maximum dimensions of at least one of the other orifices 23.

Referring again to FIG. 4, it will be seen that intermediate portion 19 of cover 16 preferably consists essentially of elastomeric material. As is known to those skilled in the art, an elastomer is a macromolecular material that returns rapdily to approximately the initial dimensions and shape after substantial deformation by a weak stress and release of the stress. See, e.g., A.S.T.M. C542.

The elastomer may be a natural rubber. Thus, e.g., it may be natural latex, which is the milk like juice of the rubber tree.

The elastomer may be a synthetic rubber which, as is known to those skilled in the art, is a hydrocarbon, polymeric material which at room temperature can be stretched to at least twice its original length and upon immediate release of the stress will return quickly to its original length.

By way of illustration and not limitation, one may use a natural latex film sold by The Hygienic Corporation, of 1245 Home Avenue, Akron, Ohio. Such a film comes in a variety of grades and thicknesses, and is available in a thickness of from about 0.010 to about 0.050 inches. These films have a 300 percent modulus (as determined by A.S.T.M. Standard Test D412-87, "Test Methods for Rubber Properties in Tension") of from about 100 to about 400 pounds per square inch, a tensile strength (as determined by A.S.T.M. D412-87) of from about 2,000 to about 4,000 pounds per square inch, an ultimate elongation (as determined by A.S.T.M. D4-12-87) of from about 400 to about 800 percent, and a Shore A durometer (as determined by A.S.T.M. Standard Test D2240-86, "Test Method for Rubber Property-Durometer Hardness") of from about 30 to about 60.

One may use other elastomeric materials. Thus, by way of illustration and not limitation, one may use styrene-butadiene elastomers (such as Buna S, SBR, GR-S, and the like), neoprene (also known as chloroprene), butyl rubber, isoprene, polyacrylate elastomers, nitrile elastomers, polybutadiene elastomers, polysulfide elastomers, EPR rubber, urethane elastomers, and the like. See, e.g., pages 284–290 of George S. Brady et al.'s "Materials Handbook," Thirteenth Edition (McGraw-Hill, Inc., New York, 1991).

Referring again to FIG. 4, intermediate portion 19 of cover 16 is preferably comprised of at least three orifices 38. It is more preferred that intermediate portion 19 comprise at least six orifices 38.

It is preferred that each of orifices 38 have a substantially circular cross-sectional shape, although other shapes (such as an oval shape, a square shape, and the like) also may be used; thus in one embodiment, not shown, the orifices may be in the shape of a slot. As is illustrated by the preferred embodiment depicted, it is also preferred that at least two of such orifices 38 have a maximum dimension (such as a diameter) which are different. In one embodiment, at least three of such orifices 38 have a maximum dimension which differs from the maximum dimensions of at least one of the other orifices 38.

As will be apparent to those skilled in the art, and referring again to FIG. 4, the largest of the orifices 38 will have a maximum dimension which is smaller than the maximum dimension of the smallest of the orifices 22 or 23.

Referring to FIG. 1, and in the preferred embodiment depicted therein, it will be seen that brusher cleaner 10 is disposed within ultrasonic cleaner 40. Any of the conventional ultrasonic cleaners known to those skilled in the art may be used in applicant's process. Thus, by way of illustration and not limitation, one may use the ultrasonic cleaners disclosed in U.S. Pat. Nos. 5,109,174, 5,102,504, 4,442,852, 4,320,528, 4,114,194, 3,871,395, 3,640,295, 3,584,244, 3,516,645, 3,480,258, and the like. The disclosure of each of these United States patents is hereby incorporated by reference into this specification.

Within ultrasonic cleaner 40, the brush cleaner 10 and the brushes 24 and the cleaning solution within base 14 are subjected to ultrasonic sound waves (those having frequencies above 20,000 hertz); see, e.g., U.S. Pat. No. 5,120,703.

Figure 9:
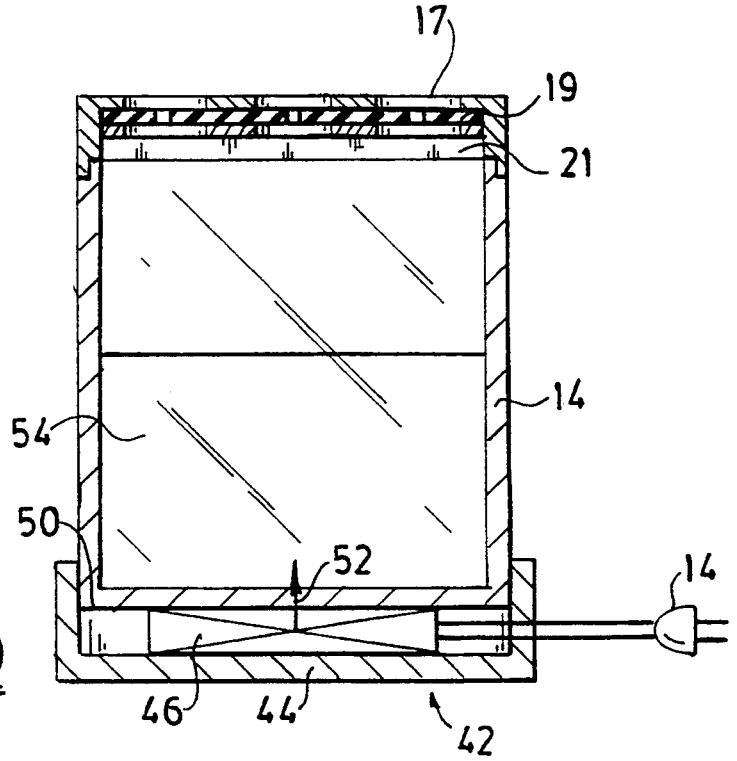
FIG. 9 is a sectional view of the cleaner of FIG. 8 disposed within an ultrasonic generator.

In one embodiment, not shown in FIG. 1 (but see FIG. 9), a means for generating ultrasonic sound waves is connected to base 14 of brush cleaner 10. Referring to FIG. 9, ultrasonic sound wave generator apparatus 42 is preferably an integral structure comprised of a base, an ultrasonic sound wave generator 46, a means for conveying electrical energy 48 to generator 46, and a wall 50 disposed over said ultrasonic sound wave generator 46 which may be used to support base 14. The ultrasonic sound waves (not shown) may pass in the direction of arrow into cleaning solution 54 in which one or more brushes (not shown in FIG. 9, but see FIGS. 3, 5, 6, and 7) may be disposed.

In one embodiment, the cleaning solution 54 used in applicant's process consists essentially of water. In another embodiment, cleaning solution 54 is a solution of soap or detergent such as, e.g., a dilute solution of "DAWN" liquid soap (manufactured by the Proctor and Gamble Corporation of Cincinnati, Ohio 45202) wherein about 1 part of such liquid soap is mixed with about 10 parts of water. In yet another embodiment, one may use dilute solutions of one or more of the soaps and/or detergents disclosed in U.S. Pat. Nos. 4,133,779, 4,316,824, and 4,681,704, the entire disclosure of each of which is hereby incorporated by reference into this specification.

In another embodiment, cleaning solution 54 is comprised of or consists essentially of a non-flammable organic solvent.

Figure 8:
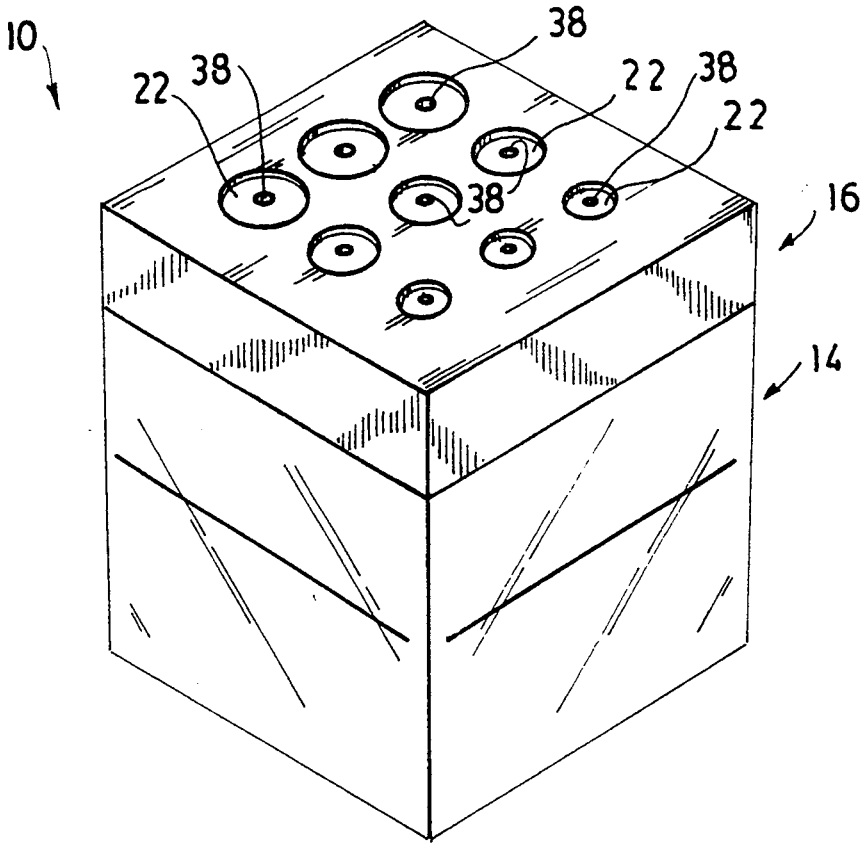
FIG. 8 is a perspective view of another preferred embodiment of the cleaner of this invention.

FIG. 8 is a perspective view of one preferred embodiment of the cleaner 10 which, except for its shape, is similar to the cleaner 10 depicted in FIGS. 1, 2, 3, and 4.

Figure 10:
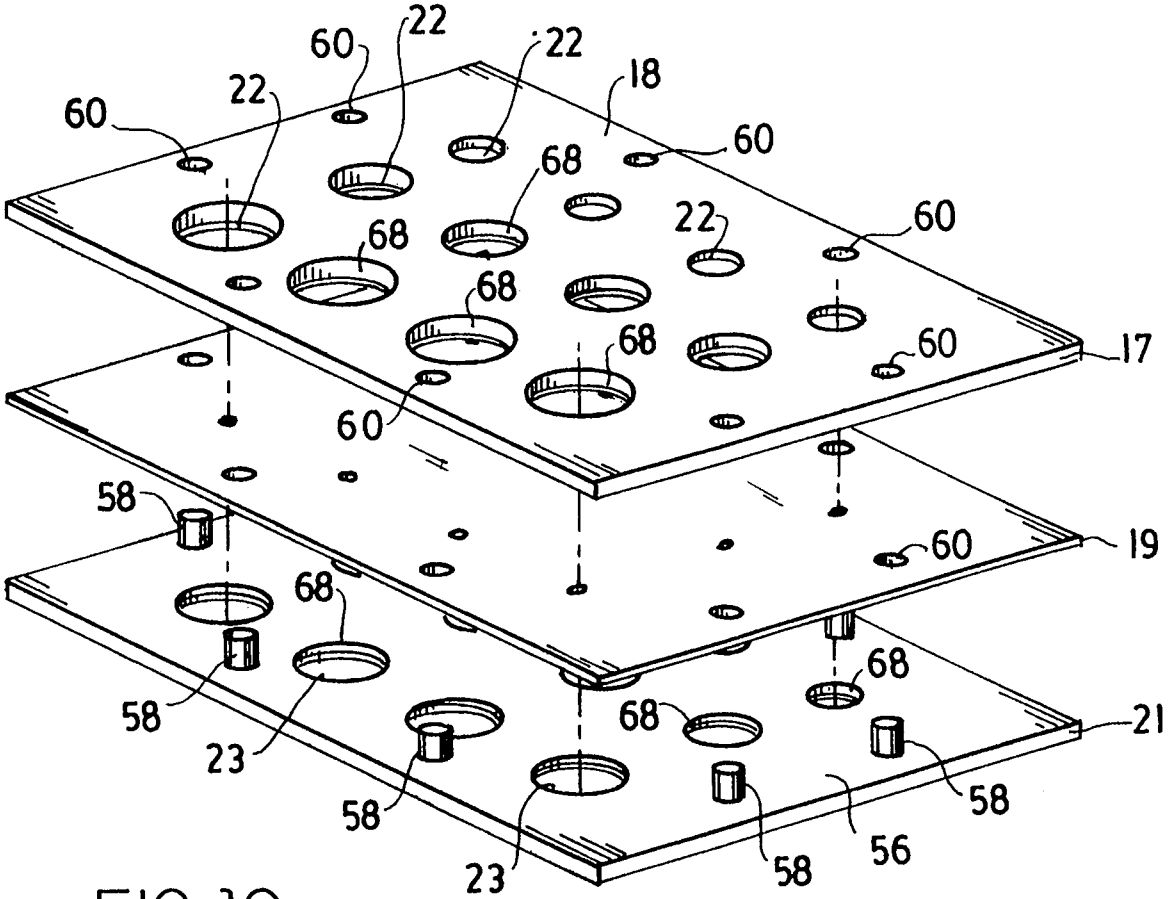
FIG. 10 is an exploded view of the top wall of the cleaner of FIG. 8.

FIG. 10 is an exploded view of the top wall 18 of cover 16 of the cleaner 10 FIG. 8. Referring to FIG. 10, and in the preferred embodiment illustrated therein, it will be seen that the interior wall 56 of bottom portion 21 of cover 16 is comprised of a multiplicity of upstanding posts 58. These posts 58 pass through orifices 60 disposed in intermediate layer 19 and top 17 to help align layers 17, 19, and 21.

Figure 7:
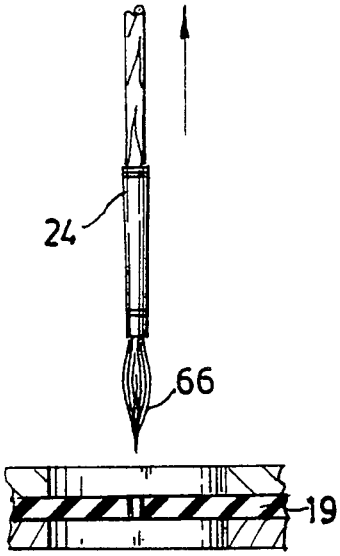

Referring to FIGS. 5, 6, and 7, it will be seen that one or more brushes 24 are passed through orifices 23, 38, and 22 (from the bottom member 21 of cover 16, through the intermediate layer 19, and through the top layer 17. The elastomeric layer 19 tends to hold brush 24 in place while its bristles are in contact with the cleaning solution 54 (not shown in FIGS. 5, 6, and 7). After bristles 62 have been subjected to the ultrasonic sound waves while in such cleaning solution for at least from about 5 to about 10 minutes, the brush 24 is pulled in the direction of arrow 64 through intermediate layer 19 (see FIG. 6) and, ultimately, out of the cleaner assembly 10 (see FIG. 7), thereby reforming bristles 62 into brush head 66.

The act of passing the bristles 62 through the elastomeric member 19 tends to squeeze excess water (or other cleaning fluid) from such bristles while, at the same time, reforming such bristles.

Referring to FIG. 10, and in the preferred embodiment illustrated therein, it will be seen that each of the orifices 23 (in member 21) and of the orifices 22 (in member 17) is preferably comprised of a beveled surface 68. In one preferred embodiment, beveled surface 68 is formed by a bevel of from about 40 to about 50 degrees. Without wishing to be bound to any particular theory, beveled surface 68 facilitates the reentry of cleaning solution 54 through orifice 22 into base 14. Furthermore, beveled surface 68 tends to deter the tearing of the intermediate section 19 when such intermediate surface 19 is contiguous with top wall 17.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for cleaning and reforming a brush, wherein said apparatus is comprised of a base, and a cover removably attached to said base, and wherein:

(a) said cover is comprised of a top wall, an intermediate layer, and a bottom wall, wherein:

1. said top wall is comprised of a first orifice, a second orifice, and a third orifice, wherein at least two of said first orifice, said second orifice, and said third orifice have a maximum dimension which differs from the maximum dimension of at least one of said first orifice, said second orifice, and said third orifice, (b) said intermediate layer consists essentially of elastmeric material and is comprised of a fourth orifice, a fifth orifice, and sixth orifice, wherein the maximum dimension of each of said fourth orifice, said fifth orifice, and said sixth orifice is smaller than the maximum dimension of any of said first orifice, said second orifice, and said third orifice, (c) said bottom wall is comprised of a seventh orifice, an eighth orifice, and a ninth orifice, wherein at least two of said seventh orifice, said eighth orifice, and said ninth orifice has a maximum dimension which differs from the maximum dimension of at least one of said seventh orifice, said eighth orifice, and said ninth orifice.

2. The apparatus as recited in claim 1, wherein each of said first orifice, said second orifice, and said third orifice has a substantially circular cross-sectional shape.

3. The apparatus as recited in claim 2, wherein each of said seventh orifice, said eighth orifice, and said ninth orifice has a substantially circular cross-sectional shape.

4. The apparatus as recited in claim 3, wherein said top wall of said cover consists essentially of plastic material.

5. The apparatus as recited in claim 4, wherein said base consists essentially of plastic material.

6. The apparatus as recited in claim 5, wherein said base is an integral structure comprised comprised of at least two walls each of which has a thickness of from about 0.05 to about 0.15 inches.

7. The apparatus as recited in claim 6, wherein said top wall of said cover is comprised of at least six orifices.

8. The apparatus as recited in claim 7, wherein said bottom wall of said cover is comprised of at least six orifices.

9. The apparatus as recited in claim 8, wherein said intermediate layer consists essentially of natural latex.

10. An apparatus for cleaning and reforming a brush, wherein said apparatus is comprised of a base, an ultrasonic sound wave generator connected to said base, and a cover removably attached to said base, and wherein:

(a) said cover is comprised of a top wall, an intermediate layer, and a bottom wall, wherein:

1. said top wall is comprised of a first orifice, a second orifice, and a third orifice, wherein at least two of said first orifice, said second orifice, and said third orifice have a maximum dimension which differs from the maximum dimension of at least one of said first orifice, said second orifice, and said third orifice, (b) said intermediate layer consists essentially of elastmeric material and is comprised of a fourth orifice, a fifth orifice, and sixth orifice, wherein the maximum dimension of each of said fourth orifice, said fifth orifice, and said sixth orifice is smaller than the maximum dimension of any of said first orifice, said second orifice, and said third orifice, (c) said bottom wall is comprised of a seventh orifice, an eighth orifice, and a ninth orifice, wherein at least two of said seventh orifice, said eighth orifice, and said ninth orifice has a maximum dimension which differs from the maximum dimension of at least one of said seventh orifice, said eighth orifice, and said ninth orifice.

11. The apparatus as recited in claim 10, wherein each of said first orifice, said second orifice, and said third orifice has a substantially circular cross-sectional shape.

12. The apparatus as recited in claim 11, wherein each of said seventh orifice, said eighth orifice, and said ninth orifice has a substantially circular cross-sectional shape.

13. The apparatus as recited in claim 12, wherein said top wall of said cover consists essentially of plastic material.

14. The apparatus as recited in claim 13, wherein said base consists essentially of plastic material.

15. The apparatus as recited in claim 14, wherein said base is an integral structure comprised comprised of at least two walls each of which has a thickness of from about 0.05 to about 0.15 inches.

16. The apparatus as recited in claim 15, wherein said top wall of said cover is comprised of at least six orifices.

17. The apparatus as recited in claim 16, wherein said bottom wall of said cover is comprised of at least six orifices.

18. The apparatus as recited in claim 17, wherein said intermediate layer consists essentially of natural latex.

* * * * *